United States Patent [19]

Smith

[11] Patent Number: 4,498,486

[45] Date of Patent: Feb. 12, 1985

[54] TOBACCO BALE STEAM INJECTION

[75] Inventor: Robert N. Smith, Richmond, Va.

[73] Assignee: Philip Morris Incorporated, New York, N.Y.

[21] Appl. No.: 440,463

[22] Filed: Nov. 9, 1982

[51] Int. Cl.[3] ..... A24B 3/02; A24B 3/12; A24B 1/02

[52] U.S. Cl. ..... 131/300; 131/306

[58] Field of Search ..... 131/300-304, 131/306

[56] References Cited

U.S. PATENT DOCUMENTS

| | | | |
|---|---|---|---|
| 3,335,730 | 8/1967 | Molins | 131/304 |
| 3,898,996 | 8/1975 | Neville et al. | 131/304 |
| 4,287,897 | 9/1981 | Brackmann et al. | 131/303 |
| 4,383,538 | 5/1983 | Beard et al. | 131/304 |

*Primary Examiner*—Vincent Millin
*Assistant Examiner*—Gregory Beaucage
*Attorney, Agent, or Firm*—Arthur I. Palmer, Jr.; D. Anthony Gregory

[57] ABSTRACT

A method and apparatus for steam injection of tobacco bales for use in the opening process. In the apparatus, at least one orificed steam injection plate is brought in flush contact with a tobacco bale that is stationary or in motion and steam is caused to emit from the orifice and is thereby injected into the bale moistening, conditioning and loosening the bonds between the tobacco leaves. In the method, as the tobacco bale is conveyed past the steam injection orifice plate, the plate is moved in flush contact therewith, steam is supplied to the plate and emits therefrom through the orifices to penetrate the tobacco bale. The bale so conditioned is subsequently broken up by a rotating cylinder.

5 Claims, 4 Drawing Figures

TOBACCO BALE STEAM INJECTION

BACKGROUND

The present invention relates to the treatment of tobacco bales and more particularly to a method and apparatus for injecting steam into a bale of tobacco to moisten the tobacco and to loosen the bonds between the leaves of the bale prior to breaking the bale apart.

Tobacco bales are generally a plurality of tobacco leaves arranged in a rectangular parallelepiped in layered relationship with their leaf planes being generally mutually parallel and being generally parallel to two opposing surfaces of the bale. The other four surfaces of the bale are referred to as "grained" and are generally perpendicular to the leaf plane. The bales are held together by burlap wrapping, string or other suitable means. During forming, processing, storage and transportation of the bale, the tobacco leaves in the bale typically become stuck together and dried to some extent depending upon the environmental conditions the bale is subjected to, the characteristics of the tobacco leaves and pressure on the leaves exerted by the bale wrapping. When the tobacco is to be removed from the bale wrapping and used, it is necessary to remove the wrapping and separate the bale into predominantly individual leaves as gently as possible to minimize leaf breakage. This process is called "opening" of the bale. The breaking of the bonds between the stuck together leaves may be accomplished by moistening and heating the leaves by subjecting the bale to steaming in a vacuum chamber as in U.S. Pat. No. 3,898,996 or by steam injection into the bales as in U.S. Pat. No. 4,287,897. The steam injection device of the '897 patent includes a pair of vertical pipes between which the bale is passed by means of a conveyor belt. Steam supplied to the pipes is injected into the bale by means of a plurality of holes provided therefor in the pipes. This device suffers from a number of disadvantages including the deflection of steam by the bale and thus escape of the deflected steam without efficient penetration of the bale. Moreover, injection is effected over only a limited contact area.

SUMMARY OF THE INVENTION

The present invention alleviates to a great extent the shortcomings of the prior art steam injection method and device, by passing the bale between orifice plates in flush contact with the bale grained sides and causing steam to emit from the orifices of the plate and penetrate the bale. The presence of the plates decrease to a great extent the amount of steam which is deflected by the bale surface and which therefore does not penetrate the bale. Thus, the steam may be injected at a lower more moderate pressure and at a lower rate of steam flow.

It is the object of the present invention to provide a method and apparatus for opening a bale of tobacco by efficient steam injection at moderate pressures and temperatures.

DETAILED DESCRIPTION OF THE PREFERRED EMBODIMENTS

Figure 1:
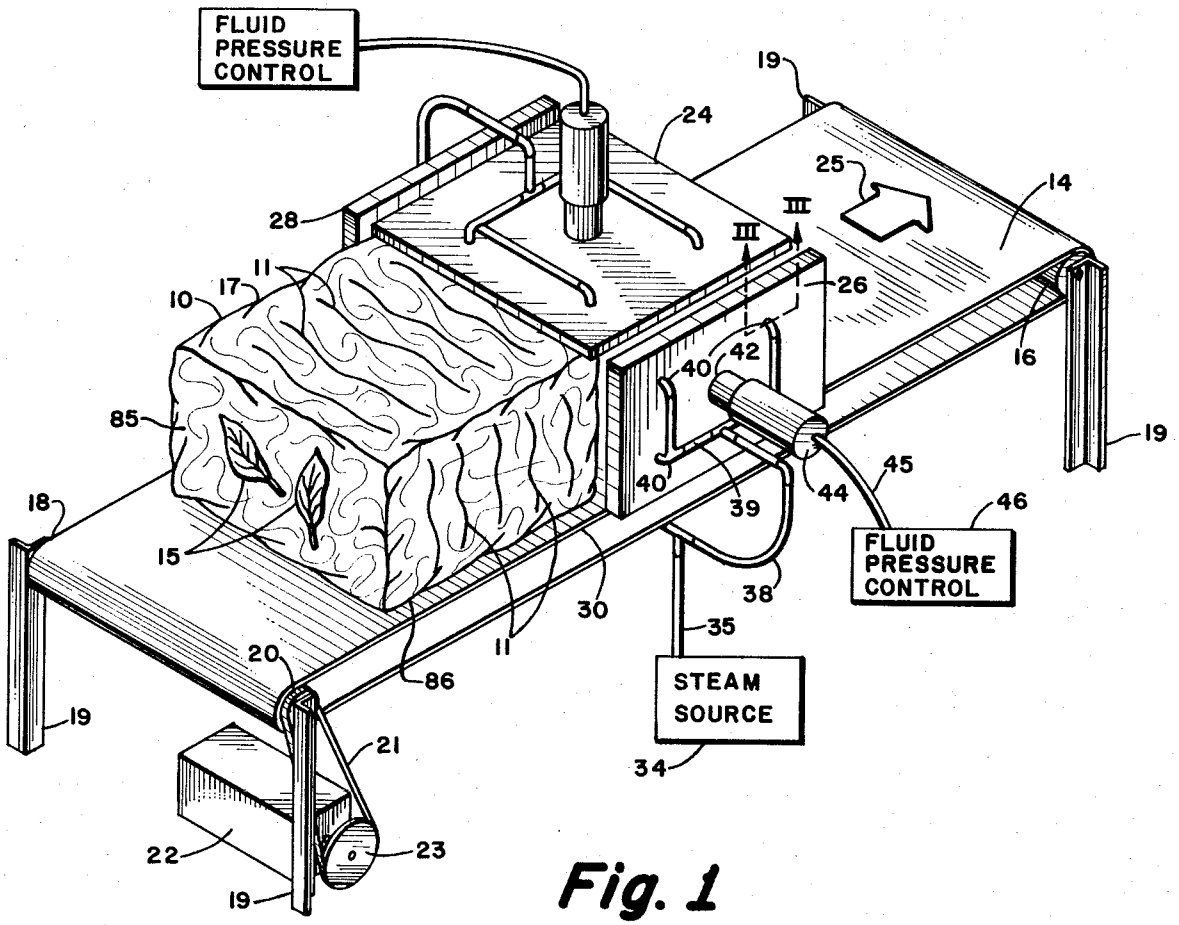
FIG. 1 is a perspective view of a tobacco bale steam injection apparatus in accordance with the present invention.

Refer now to FIG. 1 there being shown a perspective view of tobacco bale steam injection apparatus in accordance with the present invention.

Tobacco bale 10 is conveyed by conveyor 14 past the steam injection plates 24, 26, 28 and 30. Legs 19 support idle roller 16 and conveyor drive roller 18 upon which conveyor 14 is wrapped. Motor 22 turns wheel 23 which drives roller 18 by means of belt 21 and pulley 20.

Tobacco bale 10 is aligned with the grained sides 17 and 86 and the opposing sides (not shown) generally parallel with the direction of travel and nongrained side 85 and its opposing side (not shown) aligned generally normal to the direction of travel. It is preferable to position the bale with the narrowest dimension between the plates if only one or two steam injection plates are being used.

Steam injection plate 26 is oriented parallel to the lines of travel of conveyor belt 14 as represented by arrow 25 and is mounted to be movable in a direction traverse to arrow 25.

As illustrated in FIG. 1, plate 26 is movable by a pneumatic arrangement including piston 42 ridgedly attached at one end to plate 26 and extending at the opposing end into cylinder 44 which is connected to a fluid pressure control 46 via conduit 45. Suitable structural mounting (not shown) supports cylinder 44.

Steam is supplied to injection plate 26 through inlets 40 via conduit 39, flexible conduit 38 and conduit 35 from steam source 34.

Plate 28 is fixably mounted to oppose plate 26 and is provided with corresponding steam supply means (not shown). Plate 24 is mounted above and generally parallel to the plane of conveyor belt 14 and is provided with appropriate steam supply means and moving means to effect desired upward and downward movement of plate 24. Plate 30 is mounted below belt 14 and is provided with corresponding steam supply means (not shown). Each of plates 24, 26, 28 and 30 are of hollow construction with a plurality of steam injection orifices for supplying steam to bale 10 being passed thereby by conveyor 14. Alternatively, each plate could be mounted to be movable to some extent if desired.

In operation, bale 10 is positioned on conveyor 14 with the opposing nongrained sides 85 positioned generally normal to the direction of travel 25 such that the four grained sides are exposed to steam jets from the orificed surfaces of plates 24, 26, 28 and 30. In this regard, it is noted that conveyor belt 14 is porous to allow the issuance therethrough of steam from plate 30 to bale 10. As bale 10 travels between plates 24, 26, 28 and 30, movable plates 24 and 26 are urged against the surface of bale 10, moving it if necessary in contact with plates 28 and 30, thus inhibiting the escape of steam between the plates and the bale surface as the bale travels thereby. Plate 24 is conservatively sized in anticipation of the smallest probable bale traverse dimension to preclude interference with the movement of plate 26.

Figure 2:
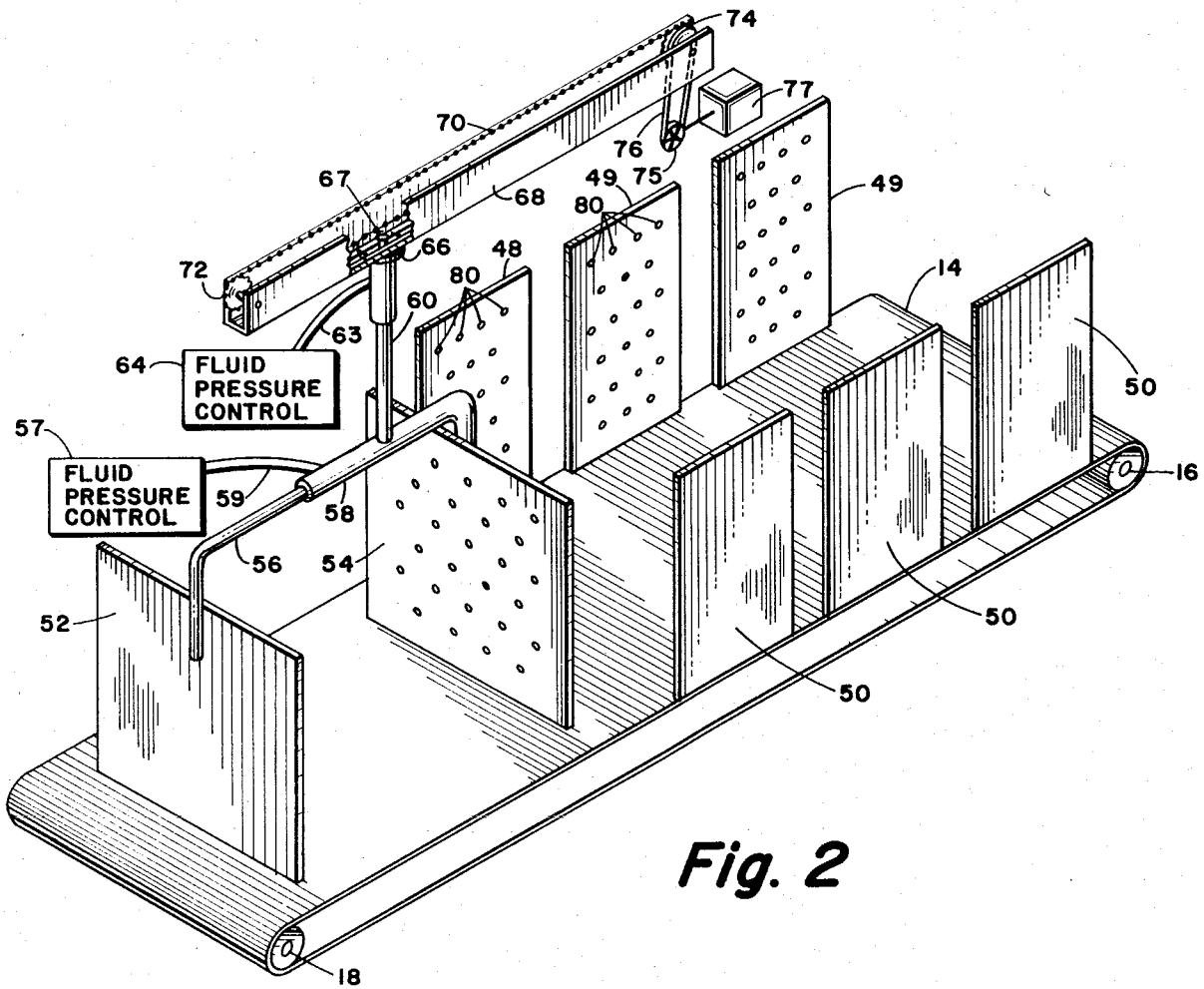
FIG. 2 is a view like FIG. 1 illustrating an alternate embodiment of the invention.

Refer now to FIG. 2, there being shown an alternate embodiment of the invention. Plates 48 and 50 are similar in construction to plates 28 and 26 respectively of FIG. 1 with associated steam supply means and moving means (not shown). FIG. 2 illustrates that a progression of plates may be used to effect a selective series of varied steam treatments. Moreover, end plates 52 and 54 are provided to inject steam into the leading and trailing ends of bale 10 (not shown) now oriented with the plane of the grains vertical. Piston 56 is attached to plate 52 and cooperates with cylinder 58 attached to plate 54 and pneumatic fluid pressure control 57 and conduit 59 to urge plates 52 and 54 together against the leading and trailing ends of bale 10.

Plates 52 and 54 ride along with bale 10 by plates 48 and 50 and are thereafter lifted via pneumatic piston 60 and cylinder 62 and pneumatic fluid pressure control 64 and conduit 63 arrangement suspended in track 68 by flange 66 and moved back by claim 70 connected to cylinder 62 by fastener 67. Chain 70 is driven by motor 77 turning wheel 75 and belt 76 turning pulley sprocket 74.

Figure 3:
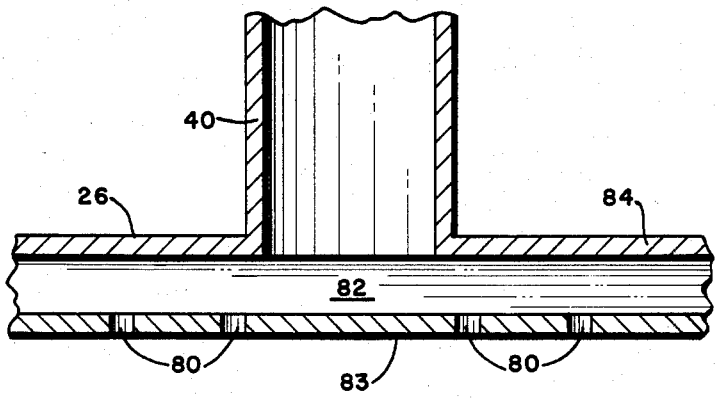
FIG. 3 is a view taken along line III—III of FIG. 1.

Refer now to FIG. 3 there being shown a sectional view of plate 26 taken along line III—III of FIG. 1. Steam enters cavity 82 through the back wall 84 of plate 26 via inlet 40, and escapes through front wall 83 via orifices 80 to be injected into a grained surface of bale 10. Orifices 80 may be any appropriate size with a preferred range of between about one and about three thirty-seconds of an inch. As the orifice decreases in size, the velocity of steam emitted therefrom increases and steam mass flow there through decreases. The increased steam velocity generally gives greater penetration into the bale.

Referring back to FIG. 1, note that four inlets 40 (three in view) are provided to plate 26. This arrangement overcomes to some extent a pressure distribution problem experienced when only a single inlet to a plate is used. In such a single inlet configuration, steam pressure within the plate decreases as distance from inlet 40 increases because steam mass is progressively lost through the orifices 80. By providing a plurality of inlets 40, the steam pressure distribution within plate 26 is flattened and more uniform steam injection into bale 10 is effected.

A steam pressure of between about forty and about sixty-five pounds per square inch gauge a steam temperature of at least about two hundred degrees Fahrenheit and a steam mass flow rate of between about twelve hundred and about seventeen hundred pounds mass per hour with a bale residence time of between about one to three minutes is preferable for a turkish bale wrapped in burlap with dimensions of about twenty-six by twenty-eight by fifteen inches with steam being injected in the two opposing largest sides which are grained sides.

Figure 4:
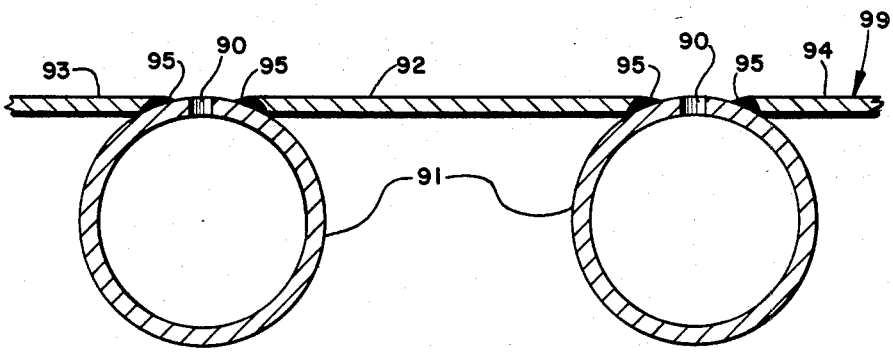
FIG. 4 is a view like FIG. 3 illustrating an alternate embodiment of an orifice plate used in the present invention.

Refer now to FIG. 4 wherein an alternate steam plate arrangement 99 is shown. Arrangement 99 includes a plurality of pipes 91 having orifices 90 and being interconnected by connecting plates 92, 93 and 94 by welds 95. Pipes 91 may be mutually aligned and interconnected in any desired configuration with correspondingly shaped connected plates such as 92 welded between to prevent the escape of deflected steam thus enabling more efficient steaming of the tobacco bale.

EXAMPLE 1

A bale of turkish tobacco wrapped in burlap with dimensions of approximately fifteen by twenty-six by twenty-eight inches and having the leaf plane generally parallel to the smallest two opposing sides, the other sides being grained, was conveyed between two generally flat rectangular steam injection orifice plates twelve inches by twenty-four inches and oriented generally parallel to two of the opposing grained bale sides and positioned for flush content therewith. Each plate had one hundred seventy-five one sixteenth of one inch diameter orifices evenly distributed over the surface of the plate in a triangular lattice pattern. As the bale progressed between the plates, one plate was moved in to effect flush contact of both plates with the bale and three hundred and forty-five degrees Fahrenheit steam supplied at a rate of seven hundred and five pounds mass per hour to each plate at a pressure of fifty pounds per square inch gauge. After six minutes, the bale had completely passed through the plates each point on the surfaces being subjected to steam injections for a residence time of two minutes. Steam penetration was complete to the center of the bale.

EXAMPLE 2

For the same conditions as Example 1, a similar bale was positioned between the plates, the plates were moved into flush contact, the stationary bale was steamed for two minutes. Steam penetration was complete to the center of the bale.

The above description and drawings are only illustrative of preferred embodiments which achieve the objects, features and advantages of the present invention and is not intended that the present invention be limited thereto. Any modification of the present invention which comes within the spirit and scope of the following claims are considered part of the present invention.

What is claimed as new and desired to be secured by Letters Patent of the United States is:

1. A tobacco bale steam injection device comprising:

at least one injection plate, each having a plurality of orifices formed in a substantially flat surface thereof;

means for urging said surface of said at least one injection plate in flush contact with a corresponding at least one side of a bale of tobacco; and, means for supplying pressurized steam to said plate so that said steam is fed to said plurality of orifices to discharge therefrom at said surface and into said corresponding side of said bale.

2. A method of steam injecting a bale of tobacco comprising the steps of:

providing at least one injection plate having a plurality of orifices formed in a substantially flat surface thereof;

urging said surface of said at least one plate in flush contact with a corresponding at least one side of a tobacco bale; and causing steam to issue through said plurality of orifices and discharge therefrom at said surface, said steam thereafter penetrating said bale.

3. A device as in claim 1 wherein the orifice dimensions and the steam pressure have magnitudes such that the emitted steam has sufficient velocity to penetrate approximately one-half of the dimension of said bale perpendicular to said at least one side of said bale.

4. A device as in claim 3 wherein: said at least one injection plate has a front wall and a back wall joined to form a cavity therebetween; said plurality of orifices being formed through said front wall; said means for supplying pressurized steam including a pressurized steam source in fliuid communication with said cavity through said back wall, said surface being an area of from about one third of to about equal to the area of said corresponding side of said bale.

5. A device as in claim 3 wherein: said at least one injection plate includes a plurality of pipes having closed ends and being disposed mutually parallel and coplanar and joined together by a plurality of connecting plates disposed coplanar to said plurality of pipes to form said surface, said plurality of orifices being formed through the walls of said pipes at said surface, said surface having an area of from about one third of to about equal to the area of said corresponding side of said bale, said means for supplying pressurized steam including a pressurized steam source in fluid communication with said plurality of pipes.

* * * * *